US011559156B2

(12) United States Patent
Stenberg

(10) Patent No.: US 11,559,156 B2
(45) Date of Patent: Jan. 24, 2023

(54) NAPKIN WITH ADHERING PORTION FOR WRAPPING CUTLERY

(71) Applicant: Essity Hygiene and Health Aktiebolag, Gothenburg (SE)

(72) Inventor: Martin Stenberg, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 16/769,819

(22) PCT Filed: Dec. 20, 2017

(86) PCT No.: PCT/EP2017/083816

§ 371 (c)(1),
(2) Date: Jun. 4, 2020

(87) PCT Pub. No.: WO2019/120514

PCT Pub. Date: Jun. 27, 2019

(65) Prior Publication Data

US 2020/0367681 A1 Nov. 26, 2020

(51) Int. Cl.

| | |
|---|---|
| ***A47G 21/16*** | (2006.01) |
| ***A47G 11/00*** | (2006.01) |
| *B31D 1/04* | (2006.01) |

(52) U.S. Cl.

CPC ..... *A47G 21/16* (2013.01); *A47G 11/001* (2013.01); *A47G 2021/162* (2013.01);
(Continued)

(58) Field of Classification Search

None

See application file for complete search history.

(56) References Cited

U.S. PATENT DOCUMENTS

| | | | |
|---|---|---|---|
| 2,145,139 | A | 1/1939 | Scharfenberg |
| 2,423,581 | A | 7/1947 | Clark |

(Continued)

FOREIGN PATENT DOCUMENTS

| | | | |
|---|---|---|---|
| CN | 102369144 | A | 3/2012 |
| CN | 102781287 | A | 11/2012 |

(Continued)

OTHER PUBLICATIONS

Australian Government, IP Office, Examination Report No. 1 issued in AU Application No. 2017443538, dated Feb. 5, 2021 (4 pages).

(Continued)

*Primary Examiner* — Alexander S Thomas

(74) *Attorney, Agent, or Firm* — Cantor Colburn LLP

(57) ABSTRACT

A napkin is provided with an adhering portion and an engaging location that can releasably adhere together. The adhering portion is located on an upper side of the napkin and the engaging location is located on the lower side such that the napkin can be wrapped around items of cutlery and secured to form a wrap by engaging the adhering portion with the engaging location. The adhering portion and the engaging location are provided with mutually adhesive material that allows the adhering portion and the engaging location to releasably adhere to each other but which mutually adhesive material does not adhere to the napkin material. A cutlery wrap using the napkin of this design and a method for wrapping cutlery are also provided.

14 Claims, 5 Drawing Sheets

(52) U.S. Cl.
CPC ..... *B31D 1/04* (2013.01); *Y10T 24/1312* (2015.01); *Y10T 428/14* (2015.01)

(56) References Cited

U.S. PATENT DOCUMENTS

| | | | |
|---|---|---|---|
| 2,529,060 | A | 11/1950 | Bertram |
| 3,398,438 | A | 8/1968 | Fried et al. |
| 3,654,059 | A | 4/1972 | Zisblatt |
| 3,978,553 | A | 9/1976 | Honig |
| 4,286,639 | A | 9/1981 | Murphy |
| 5,011,017 | A | 4/1991 | Giesen |
| 5,188,877 | A | 2/1993 | Magaro |
| 5,260,536 | A | 11/1993 | Peery |
| 5,468,534 | A | 11/1995 | Godfrey et al. |
| 5,552,200 | A | 9/1996 | Gureff |
| 5,560,800 | A | 10/1996 | Liu et al. |
| 5,672,056 | A | 9/1997 | Fisher et al. |
| 6,021,550 | A | 2/2000 | Welch |
| 6,079,048 | A | 6/2000 | Campbell |
| 6,971,218 | B1 | 12/2005 | Huckaba et al. |
| 8,651,275 | B1 | 2/2014 | D'Aloisio |
| 8,703,270 | B2 | 4/2014 | Hummerich |
| 2001/0006726 | A1 | 7/2001 | Arakawa et al. |
| 2001/0032967 | A1 | 10/2001 | Carlson et al. |
| 2002/0051863 | A1 | 5/2002 | Chan |
| 2002/0088592 | A1 | 7/2002 | Drew et al. |
| 2002/0124534 | A1 | 9/2002 | Heisey |
| 2003/0105183 | A1 | 6/2003 | Sharak |
| 2003/0212195 | A1 | 11/2003 | Matsumoto et al. |
| 2004/0224116 | A1 | 11/2004 | Manasa |
| 2005/0148257 | A1 | 7/2005 | Hermans et al. |
| 2005/0252057 | A1 | 11/2005 | Lavi |
| 2006/0173431 | A1 | 8/2006 | Laumer et al. |
| 2006/0174390 | A1 | 8/2006 | Wakhloo et al. |
| 2007/0061939 | A1 | 3/2007 | Rose |
| 2007/0185469 | A1 | 8/2007 | Green |
| 2007/0205212 | A1 | 9/2007 | Klingel |
| 2008/0302066 | A1 | 12/2008 | Lavi |
| 2009/0321552 | A1 | 12/2009 | Hada et al. |
| 2010/0213699 | A1 | 8/2010 | Tremper |
| 2011/0240722 | A1 | 10/2011 | Stromme |
| 2013/0086725 | A1 | 4/2013 | Sabre |
| 2013/0171408 | A1 | 7/2013 | Carlson |
| 2014/0034254 | A1 | 2/2014 | Qin et al. |
| 2015/0064416 | A1 | 3/2015 | Wolf et al. |
| 2015/0122408 | A1 | 5/2015 | Shaw |
| 2015/0298420 | A1 | 10/2015 | Gungner et al. |
| 2018/0206558 | A1 | 7/2018 | Bannan |
| 2020/0060451 | A1 | 2/2020 | Stenberg |
| 2021/0177171 | A1 | 6/2021 | Petro |

FOREIGN PATENT DOCUMENTS

| | | | |
|---|---|---|---|
| CN | 103997940 | A | 8/2014 |
| CO | 14139635 | | 7/2013 |
| CO | 6990698 | A2 | 7/2014 |
| DE | 1810867 | A1 | 6/1969 |
| DE | 4335279 | A1 | 4/1995 |
| DE | 29622148 | U1 | 3/1997 |
| DE | 102007033572 | A1 | 1/2009 |
| EP | 1935296 | A2 | 6/2008 |
| FR | 2784563 | A1 | 4/2000 |
| FR | 2787002 | A3 | 6/2000 |
| GB | 598017 | A | 2/1948 |
| GB | 1148145 | A | 4/1969 |
| GB | 1552154 | A | 9/1979 |
| GR | 1006004 | B | 7/2008 |
| NL | 1038110 | C2 | 1/2012 |
| WO | 2011039533 | A1 | 4/2011 |
| WO | 2013100841 | A1 | 7/2013 |
| WO | 2016102080 | A1 | 6/2016 |
| WO | 2018082761 | A1 | 5/2018 |
| WO | 2019120514 | A1 | 6/2019 |

OTHER PUBLICATIONS

Russian Patent Office, Notification of Examination Results issued in RU Application No. 2020121421, dated Jan. 25, 2021 with English translation (19 pages).
Mark, Richard E.., et al., "Handbook of Physical Testing of Paper," vol. 1, Second Edition, pp. 662, https://books.google.com.co/books?id=Wh_KqCXPn3gC&printsec=frontcover&hl=es#v=onepage&q&f=false, 2002.
Sizes, Inc. "Napkins," Dec. 20, 2002, https://www.sizes.com/home/napkins.htm.
Wikipedia, "Tissue Paper," Oct. 9, 2016, https://en.wikipedia.org/w/index.php?title=Tissue_paper&oldid=743359080.
Habeger, Jr., Chalres C., et al., "Handbook of Physical Testing of Paper," vol. 1, pp. 662 (book not available, google book link: https://books.google.com.co/books?id-Wh_KqCXPn3gC&printsec=frontcover&hl=es#v=onepage&q&f=false) 2 pages, 2001.
International Searching Authority, Written Opinion of the International Searching Authority, International Application No. PCT/EP2017/083816, dated Aug. 31, 2018 (8 pages).
International Searching Authority, Search Report of the International Searching Authority, International Application No. PCT/EP2017/083816, dated Aug. 31, 2018 (6 pages).
Chinese Patent Office, Office Action issued in CN Application No. 201780097380.7, dated Aug. 3, 2021 with English translation (18 pages).
Chilean Patent Office, Office Action issued in CL Application No. 2020-001676, dated Jul. 14, 2021 (15 pages).
Andean Patent Manual. OMPI, Andean Community Secretary, 2004. ISBN-9978-43-855-6. Section 10.8.1 (no document located).
Brazilian Patent Office, Office Action issued in BR Application No. BR112020009526-5, dated Mar. 9, 2022, 4 pages.
Canadian Patent Office, Office Action issued in CA Application No. 3096762, dated Mar. 2, 2022, 4 pages.
Chilean Patent Office, Office Action issued in CL Application No. 2020-001676, dated Apr. 8, 2022 (13 pages).
China National Intellectual Property Administration, 2nd Office Action issued in Chinese Patent Application No. 201780097380.7 dated Apr. 6, 2022 and English translation (17 pages).
China National Intellectual Property Administration, Office Action and Search Report issued in Chinese Patent Application No. 201680090406.0 dated Jan. 6, 2020 and English translation (13 pages).
Clarkson, Paul Magnus, Response to Written Opinion and Search Report filed in International Application No. PCT/EP2016/076297 dated Aug. 31, 2018 (10 pages).
Colombia Industria Y Comercio, Office Action issued in Colombia Patent Application No. NC2019/0004559, dated Sep. 21, 2020 with English language explanation of relevance included (15 pages).
Colombia Industria Y Comercio, Office Action issued in Colombina Patent Application No. NC2019/0004559, dated Apr. 24, 2020 (8 pages).
Colombian Patent Office, Office Action issued NC2019/0004559 dated Mar. 15, 2021 (with English translation) 16 pages.
National Intellectual Property Administration of the People's Republic of China, 2nd Office Action and Supplementary Search Report issued in CN Application No. 201680090406.0, dated Sep. 3, 2020, with English translation (18 pages).
Russian Patent Office, Office Action issued in Russian Patent Application No. 2019116607 dated Jul. 16, 2019 and English translation (10 pages).
Colombian Patent Office, Office Action issued NC2020/0007889 dated May 9, 2022 (9 pages).
Final Office Action dated Feb. 22, 2022; U.S. Appl. No. 16/346,645.
Colombian Application No. NC2020/0007889 filed Jun. 26, 2020; Colombian Office Action with English Translation dated Aug. 19, 2022; 11 pages.

NAPKIN WITH ADHERING PORTION FOR WRAPPING CUTLERY

CROSS-REFERENCE TO RELATED APPLICATION

This application is a national phase entry of, and claims priority to, International Application No. PCT/EP2017/083816, filed Dec. 20, 2017. The above-mentioned patent application is incorporated herein by reference in its entirety.

TECHNICAL FIELD

This application relates to table napkins and, more particularly, to disposable napkins that may be used to wrap a service of cutlery as may be provided for an individual place setting in a restaurant or other catering facility. This application also relates to the use of such a napkin for wrapping cutlery and a method of providing individual place settings.

BACKGROUND

Napkins are used in catering and the home in a variety of different forms. Cloth napkins are generally used for fine dining, whereas disposable napkins tend to be more conventional in higher volume establishments. Amongst the disposable napkins there may also be considerable variation, ranging from high-end cloth-like non-wovens to serviettes dispensed from a bulk dispenser or roll.

One particular use of the napkin is to wrap cutlery as an individual place setting. Such wraps may be prepared in advance, containing e.g. a knife and fork or a knife, fork and spoon. The waiter or restaurant staff can then quickly provide the requisite number of wraps to a table. Alternatively, diners e.g. in a buffet setting can take their own wrap from a pile or basket.

Preparing such wraps is a time consuming exercise involving the steps of:

taking a napkin from a pile;

taking a set of cutlery and laying it on the napkin;

wrapping or rolling the napkin around the cutlery; and securing the wrap with a clip, band or sticker.

The final step of securing the connection requires an additional element such as the self-adhesive napkin bands available from AmerCareRoyal, LLC of Baltimore, Md. Such an additional element increases the cost of the wrap and adds to the time of production. Additionally, during use, it leads to an additional item of waste that may be present on the table during the meal and is sometimes unsightly.

It would be desirable, therefore, to provide a napkin that can be used to wrap cutlery to form individual place settings without necessitating the use of a separate clip, band or sticker as is typical in the conventional designs summarized above.

SUMMARY

To address the problems with conventional napkins and cutlery wrappings, a napkin is provided according to one embodiment of the invention such that the napkin includes a napkin material and having an upper side, a lower side and four corners, the napkin being provided with an adhering portion and an engaging location. The adhering portion is located on the upper side and the engaging location is located on the lower side at corresponding positions such that the napkin can be wrapped around an object and secured by engaging the adhering portion with the engaging location. The adhering portion and the engaging location being provided with a mutually adhesive material that allows that the adhering portion and the engaging location to releasably adhere to each other but which mutually adhesive material does not adhere to the napkin material. Preferably, the adhesive material only adheres to the adhesive material itself, i.e. with the adhesive material or a surface provided with the adhesive material. This means that the adhesive material preferably does not adhere with anything else other than the adhesive material.

Where reference is made herein to the upper side or lower side of the napkin, this means the effective surfaces of the napkin, i.e. the first side and the second side (also, interchangeably referred to as front and back surface) of the napkin.

A suitable location for the adhering portion is at a corner of the napkin. It will be understood that this refers to the napkin in the state prior to wrapping. Since napkins will generally be folded, this does not mean that the adhering portion will necessarily be located at a corner of the unfolded napkin. In fact, in particular embodiments, the adhering portion will be located other than at the corner of the unfolded napkin. In the following, in order to avoid ambiguity, reference to the napkin is to the napkin as it is stacked or presented prior to wrapping an item of cutlery. In particular embodiments, the napkin has four corners. For a napkin in its unfolded state, reference is given to a sheet having points.

The engaging location is in certain embodiments located close to a center of the napkin, although this will depend at least partially on the way of wrapping and the size of the item to be wrapped. The center of the napkin can be defined as the location where the two diagonals of the napkin cross each other. In some embodiments the engaging location is located close to a center of the napkin with the corners on the lower side being devoid of mutually adhesive material.

If the adhering portion is at a corner of the napkin, then in particular embodiments the engaging location is located between the corner diagonally opposite to the corner provided with the adhering portion and the center of the napkin.

In some embodiments, the engaging location extends over a zone extending substantially from a corner to the corner diagonally opposite to this corner, preferably from the corner provided with the adhering portion to the corner diagonally opposite to the corner provided with the adhering portion. The zone extending substantially from a corner to the corner diagonally opposite to this corner preferably crosses the center of the napkin.

The napkin can be provided with a releasing portion located on the lower side at a position corresponding with the adhering portion such that the napkin can be stacked with similar napkins with the releasing portion on the lower side of a first napkin aligned and engaged with the adhering portion of a second napkin located beneath the first napkin. As a result, the napkin provided with a releasing portion can be easily provided in a stack and used one by one to wrap a service cutlery. Prior to wrapping, the adhering portion retains the napkin to the stack and on completion of the wrapping operation, the adhering portion secures the wrap and prevents the napkin from opening. It will be understood that for an adhesive portion that is mutually adherent to the engaging location, the releasing portion should be similarly provided with a similar mutually adhesive material that can adhere to and release from the adhesive portion.

In particular embodiments, the napkin is not provided with a releasing portion. In such embodiments stacking of the napkins may take place without mutual adhesion. In other words, the engaging location comprising material that is mutually adhesive to the adhering portion is provided only at a location or locations that do not align with the adhering portion of an adjacent napkin when napkins are stacked one above the other. For an adhesive portion provided close to a corner of the napkin, the engaging location will not be located at a corner. It may comprise a location close to the center of the napkin.

The napkin may be a single sheet having a maximum extent defined by the four corners. More usually however, the napkin will include a sheet that has been folded at least once. In one embodiment, the napkin includes a sheet having an inner surface and an outer surface that has been folded at least once with the inner surface inwards. The at least one fold may bisect the sheet or be offset from the center line. In this case, it will be understood that both the adhering portion and the engaging location will be located on the outer surface. It is noted in this context that certain napkins and the like have in the past been provided with attachment means or elements for sticking to a user's clothing. In that case however, the attachment is provided on the inner surface of the sheet that forms the napkin. This is of course particularly important where there is a clearly defined difference e.g. in quality, pattern or texture between the inner surface and the outer surface.

In many embodiments, the sheet is twice-folded to form the napkin with the outer surface exposed and the four points of the sheet aligned at a first corner of the napkin. A large class of disposable paper napkins are of this type and of the napkins that are used for making cutlery service wraps, this is by far the most common, since it provides a wrap that is of suitable size to enclose the service and yet can be opened out to four times the area for dining. In further embodiments, the first and/or the second fold may be offset from a line bisecting the sheet. In a particular embodiment, the first fold is offset such that two of the points, in particular the two outer points, are aligned at a first corner and the other two points are aligned at a location interior of the first corner.

For a twice-folded napkin, there are two corners that are preferred for providing the adhering portion, since they lead to a wrap that is less likely to open. These are the two corners that lie on the second fold of the twice-folded napkin and may be referred to as the "closed" corners. In a first embodiment the adhering portion may be provided adjacent a second corner of the napkin, diagonally opposite to the first corner. This is the corner closest to the center of the sheet. In this case, the engaging location may be provided between the second corner and a center of the napkin. An alternative to this arrangement is for the adhering portion to be located at or adjacent a third corner of the napkin with the engaging location being provided between a third corner and a center of the napkin. In this case, the third and fourth corners are the adjacent corners to the first corner, with the third corner being the "closed" corner.

In further alternative embodiments, the adhering portion may be provided at or adjacent a second corner of the napkin, diagonally opposite to the first corner and the engaging location may comprise a zone extending substantially from the first corner to the second corner thereby crossing the center of the napkin.

Alternatively, the adhering portion may be provided at or adjacent a third corner of the napkin and the engaging location may comprise a zone extending substantially from the third corner to a corner diagonally opposite to the third corner thereby crossing the center of the napkin.

All of the above assumes that the napkin is wrapped around the cutlery service along a diagonal of the napkin. It will nevertheless, be understood that other methods of wrapping may be applied, e.g., parallel to a side of the napkin. In that case, the adhering portion may be located at a different location and engaging location will be positioned accordingly.

In yet further embodiments, the sheet may have three or four folds, with each fold bisecting the sheet or being offset from a bisecting line. The three folded napkin may include two parallel folds and a third perpendicular fold, with the first two folds being C- or Z-folded. Alternatively, the first fold may be the perpendicular fold and the second two folds may be the parallel folds in a C- or Z-fold pattern. Yet further, the three folded napkin may be folded in a manner similar to the twice-folded napkin followed by an additional bisecting or offset fold.

The sheet that forms the napkin may be manufactured of any suitable material and the skilled person will choose the material according to the quality and intended use required of the napkin. In particular, the sheet may be manufactured of one or several layers or plies of fibrous material, for example cellulose-based absorbent material, such as tissue or air-laid, including dry crepe, wet crepe and structured tissue. It is also possible to use fibrous materials which entirely or partially consist of synthetic single- or multi-component fibres and/or regenerated cellulose fibres, such as fibres including polyamide, polypropylene, polyethylene, polyester, viscose, etc. Multi-ply napkins may be laminated in a conventional way by co-embossing of the component plies or by gluing. In one embodiment the sheet is multi-ply tissue having a weight per ply of between 14 $g/m^2$ and 30 $g/m^2$, preferably between 15 $g/m^2$ and 24 $g/m^2$ or even between 16 $g/m^2$ and 18 $g/m^2$. In another embodiment, the napkin is formed by folding a sheet of single-ply air-laid non-woven having a weight of between 25 $g/m^2$ and 80 $g/m^2$, preferably between 30 $g/m^2$ and 70 $g/m^2$ or even between 40 $g/m^2$ and 60 $g/m^2$. In a further embodiment the sheet is single-ply tissue having a weight of between 14 $g/m^2$ and 40 $g/m^2$, preferably between 16 $g/m^2$ and 30 $g/m^2$ or even between 18 $g/m^2$ and 22 $g/m^2$ The napkin may be any suitable size according to the desired use. With reference to the unfolded size of the sheet, the sheet may have maximum dimensions of between 20 cm and 60 cm, including cocktail size (20 cm×20 cm), lunch size (30 cm×30 cm), standard size (40 cm×40 cm), luxury size (50 cm×50 cm) or any other intermediate size desired. In general, the sheet may be square. In this context, square is intended to cover shapes that the user will perceive as being square even though adjacent sides may not be equal. In certain circumstances, the sheet may be non-square even though the napkin is folded to a square or vice-versa.

It is also understood that the outer surface of the sheet from which the napkin is formed may be patterned, e.g. printed or embossed, to distinguish it from the inner surface. In this context, we may refer to the fact that the outer surface is the quality surface that is intended to be visible e.g. when the napkin is presented and when it is placed on a user's lap. The embossing may have taken place onto the outer surface, which is sometimes referred to as the female side. The adhering portion may be provided on this outer surface as may be the engaging location. For this reason, it may be important to ensure that these portions are of an acceptable visual appearance both before use, when wrapped, and during use.

The adhering portion and the engaging location are provided with a mutually adhesive material that allows the adhering portion and the engaging location to releasably adhere to each other but which mutually adhesive material does not adhere to the napkin material. Preferably, the adhesive material only adheres to itself. Examples of such mutually adhesive materials may include adhesives that only stick to each other. Such adhesives are sometimes referred to as envelope-glue and may comprise water based adhesives for example water based acrylic adhesives and pressure sensitive adhesives, such as pressure sensitive hot melts or cold seal adhesives, which only sticks in case of mutual contact, or other types of male-male or male-female connections which adhere to each other but not to their environment. In this case, the adhering portion and the engaging location and optionally the releasing portion are provided with complementary surfaces that releasably adhere to each other but do not adhere to the napkin material. In some embodiments the mutually adhesive material of the adhering portion and of the engaging location comprises a cold seal adhesive. A cold seal adhesive can be defined as an adhesive that bond when exposed to pressure only. A cold seal adhesive has no tack or minimal tack to surfaces not provided with a cold seal adhesive. By using cold seal adhesives the adhering portion and the engaging location can be sealed and unsealed without damaging, for example tearing, the napkin material. Cold seal adhesives are distinguished from heat seal adhesives which require a source of heat and pressure to make the bond. Cold seal adhesives are different from pressure-sensitive adhesives which are permanently tacky and require a release paper cover to prevent adhering to anything until the final use. Cold seal adhesives are for example selected from the group consisting of natural rubber, synthetic rubbers and copolymers thereof. Synthetic rubbers may be preferred as natural rubbers may cause allergic reactions. Synthetic rubbers comprise for example chloroprene rubber or isoprene rubber.

The mutually adhesive material of the adhering portion and of the engaging location may be designed to retain the engaging portion for at least 24 hours, while at the same time being possible to separate the two portions without destroying one or both of them. In certain embodiments, the mutually adhesive material may be transparent or may be in itself decorative.

The adhering portion may be circular, square, triangular and of any size suitable for its function. It may be a logo or a print of motif. The same may apply to the engaging location and; if a releasing portion is present, to the releasing portion. The engaging location will generally be significantly larger, since it is configured to allow for variations in wrapping. It will be understood that the surface of the engaging location may be less absorbent than other regions of the napkin and for this reason, it may not be desirable for the engaging location to extend over a large area of the napkin. In one particular embodiment, the outer surface of the sheet from which the napkin is formed is uniform over its whole surface except for the adhesive portion an the engaging location. Only these regions may be provided with the mutually adhesive material allowing as much of the outer surface as possible to be available to perform its function as a napkin.

If a releasing portion is present, the releasing portion may have the same size or a larger size than the adhering portion. It is also not excluded that the engaging location extends to and includes the releasing portion.

The mutually adhesive material can be applied by any technique known in the art. This may include gravure, spray, roll or slot coating processes or printing, at any stage in the manufacture of the napkin. The shape of the adhering portion, the engaging location and optionally the releasing portion may be dependent upon the process used for its application. In many embodiments, the mutually adhesive material of the adhering portion as well as of the engaging location and optionally of the releasing portion will be applied during the manufacturing process of the napkin, often referred to as the conversion process and preferably at a late stage in the process, e.g. immediately before, during or after folding.

In a still further embodiment, the mutually adhesive material of the adhering portion, the engaging location and optionally the releasing portion may be provided on separate elements such as stickers or tape portions that are applied to the napkin during production. These elements may be double sided adhesive tape with a first adhesive side and a second tacky side.

The adhering portion and/or the engaging location and/or the releasing portion, if present, may be arranged to increase the strength properties of the napkin surface and/or between layers via e.g. coating, embossing or lamination.

Further embodiments of the invention also relate to a stack of napkins as defined above or hereinafter. In case the napkins are provided with a releasing portion, the napkins are preferably piled together with the releasing portions on the lower sides of the napkins aligned and releasably engaged with the adhering portion of an adjacent napkin in the stack.

Another embodiment of the invention provides a cutlery wrap including one or more items of cutlery, wrapped in a napkin, the wrap being secured by engagement of an adhering portion on the napkin with an engaging location at another position on the napkin. In this manner, a cutlery wrap may be achieved without the use of any additional element such as a ring, clip or sticker to hold the wrap together.

Furthermore, a method of wrapping cutlery to form a cutlery wrap is provided in still further embodiments of the invention, the method including:

- providing a napkin comprising a napkin material and having an adhering portion and an engaging location, the adhering portion and the engaging location being provided with a mutually adhesive material that allows the adhering portion and the engaging location to releasably adhere to each other but which mutually adhesive material does not adhere to the napkin material;
- placing one or more items of cutlery onto the napkin;
- wrapping the cutlery in the napkin; and
- engaging the adhering portion with the engaging location on the napkin to secure the wrap.

The napkin may be a napkin as described above or hereinafter.

In a particularly convenient manner of forming the wrap, the napkin is provided in a stack with the upper side of the top napkin exposed and the items of cutlery are placed onto the upper side of the top napkin.

A napkin is also described, having an upper side, a lower side and four corners, the napkin including a twice-folded sheet and being provided with an adhering portion on the upper side, adjacent to one of the corners and an engaging location on the lower side at a corresponding position to the adhering portion such that the napkin can be wrapped around an object and secured by engaging the adhering portion with the engaging location. The adhering portion and the engaging location are provided with a mutually adhesive material that allows the adhering portion and the engaging portion to releasably adhere to each other but which mutually adhesive material does not adhere to the napkin material. The embodiments described may be combined in any sub-combination or combination without departing from the scope of this invention.

BRIEF DESCRIPTION OF THE DRAWINGS

The features and advantages of the invention will be appreciated upon reference to the following drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Figure 1:
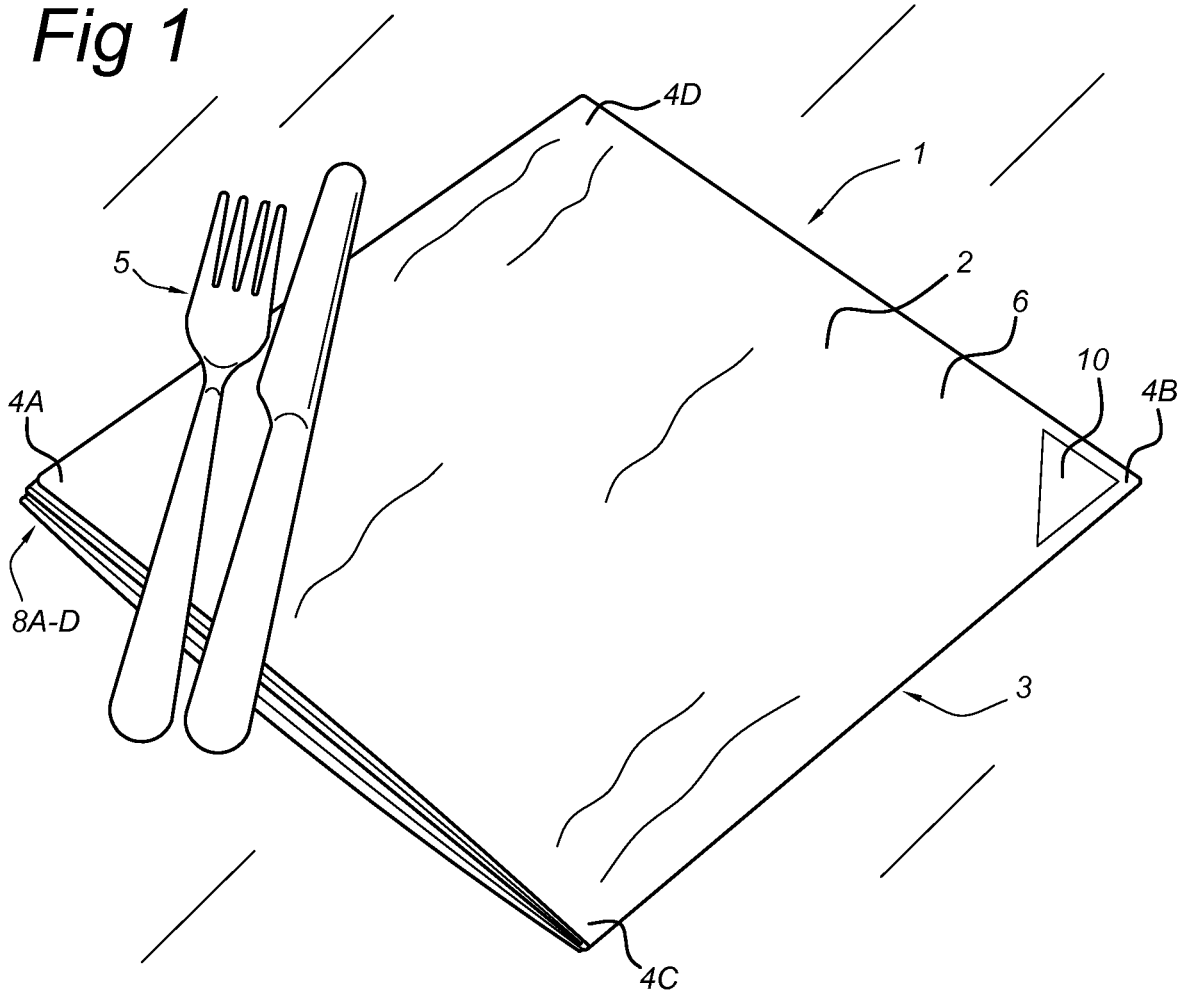
FIG. 1 is a top perspective view of a napkin according to a first embodiment.

FIG. 1 shows a schematic view of a napkin 1 according to a first embodiment together with a cutlery service 5. The napkin 1 has an upper side 2 that is visible in FIG. 1 and four corners 4 A-D. The lower side 3 of the napkin 1 is not visible in this view.

The napkin 1 is a conventional 3-ply paper tissue sheet 6 having a weight of 45 g/m$^2$ and maximum dimensions of 39 cm×39 cm unfolded size. As shown in FIG. 1, the napkin is in a twice folded state, having dimensions of 19.5 cm×19.5 cm. It will be understood that other sizes and constructions may be equally applicable. The points 8 A-D of the tissue sheet are gathered at the first corner 4A. At the diagonally opposite second corner 4B there is provided an adhering portion 10. The adhering portion 10 is a triangular region of 2 cm$^2$ that has been coated with a cold seal adhesive, such as Loctite® Liofol CS22-422.

Figure 2:
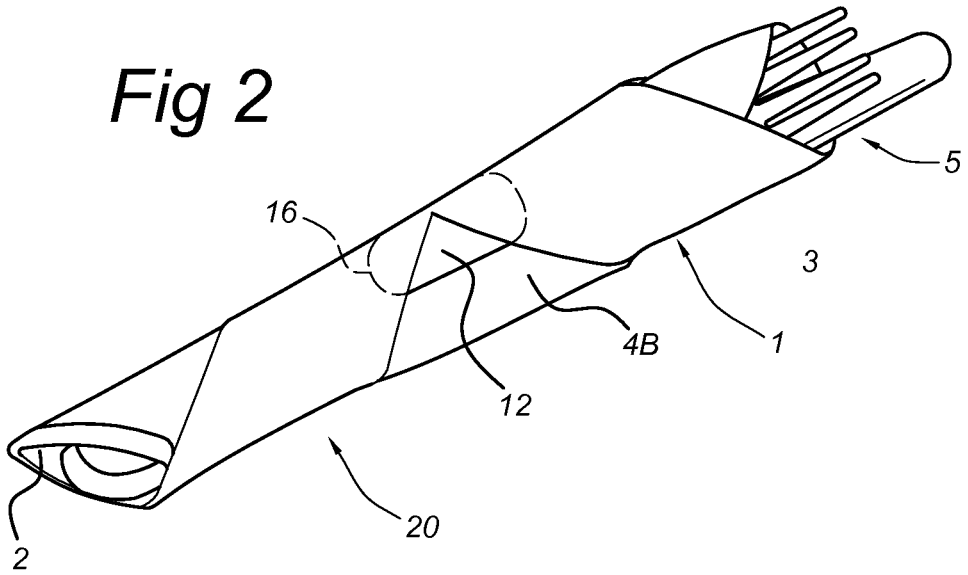
FIG. 2 is a top perspective view of the napkin of FIG. 1, formed into a cutlery wrap.

FIG. 2 shows the napkin 1 of FIG. 1, rolled around the cutlery service 5 to form a wrap 20. In this view, the lower side 3 of the napkin 1 is visible, while the upper side 2 of the napkin 1 is turned inwards towards the cutlery service 5. The napkin 1 has been rolled, starting from the first corner 4A and the second corner 4B is outermost. In this state, the adhering portion 10 engages over an engaging location 16 on the lower side 3 of the napkin 1 and engages therewith by the action of the adhering portion 10. The engaging portion has also been coated with a cold seal adhesive, such as Loctite® Liofol CS22-422. The engagement between the adhering portion 10 and the engaging location 16 should be sufficient to secure the wrap 20 against spontaneous unwrapping even after handling of wraps 20 during setting of tables or the like. In particular embodiments, it should also be sufficient to remain engaged for a period of at least 24 hours. On the other hand, it should not be so well adhered that the wrap 20 may not be opened without damaging the napkin 1 to the extent that it may be unacceptable to a user.

The napkin may or may not be provided with a releasing portion 12. In the embodiment shown in FIG. 2, the napkin is provided with a releasing portion 12 located on the lower side 3 at the second corner 4B, such that it directly corresponds to the position of the adhering portion 10.

Figure 3:
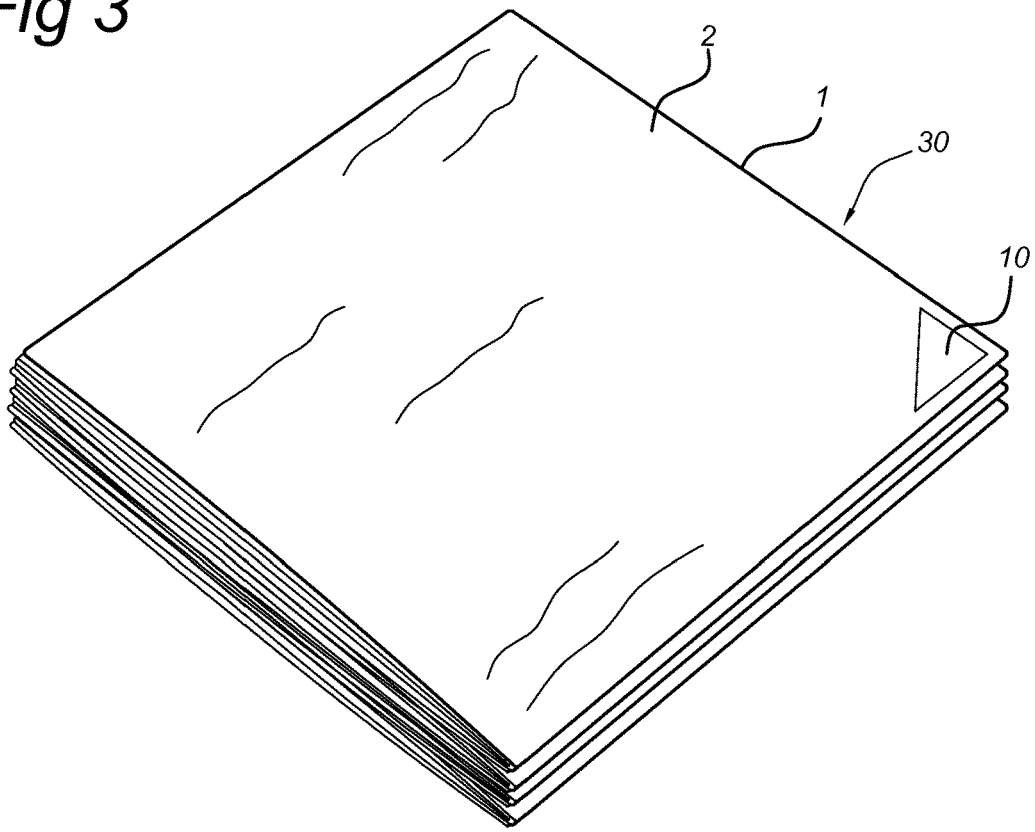
FIG. 3 is a top perspective view of a stack of the napkins of FIG. 1.

FIG. 3 shows a stack 30 of napkins 1 according to FIG. 1. All of the napkins 1 in the stack 30 are located with their upper side 2 upwards and the adhering portion 10 of the uppermost napkin 1 is visible. The napkins may or may not be provided with a releasing portion.

Figure 4:
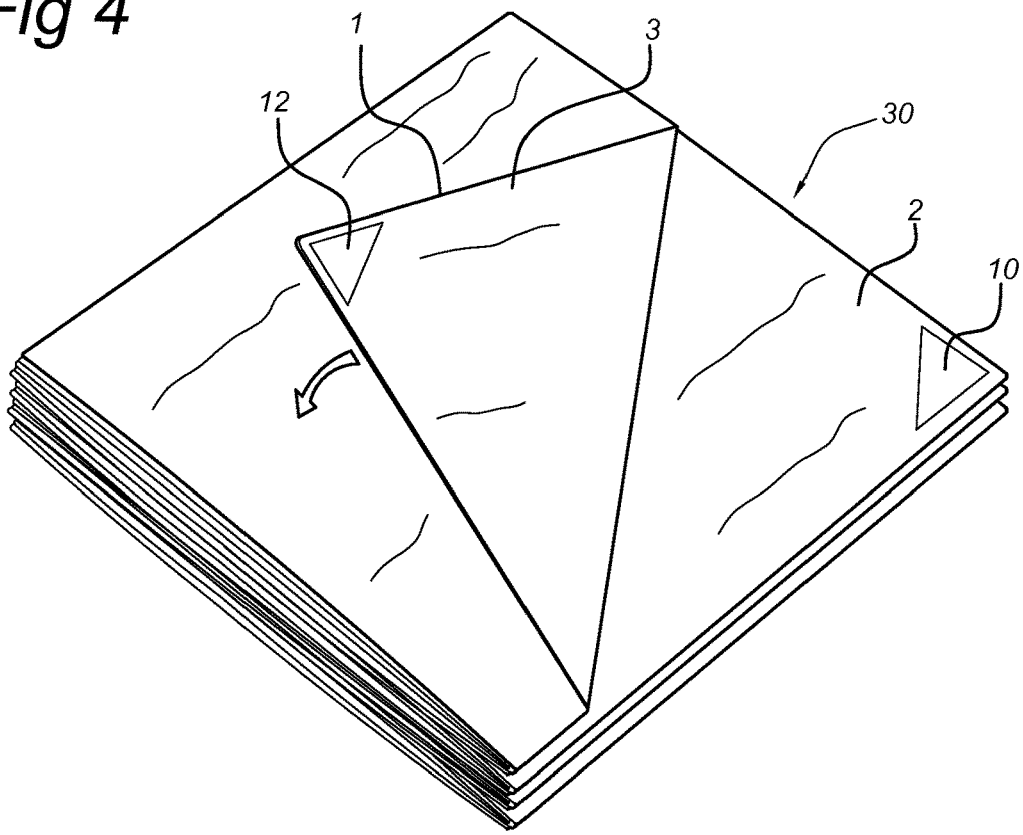
FIG. 4 is a top perspective view of the stack of FIG. 3, with the uppermost napkin partially folded back to reveal further elements thereof.

FIG. 4 shows the stack of FIG. 3, with the uppermost napkin 1 partially turned back to reveal its lower side 3 and the upper side 2 of the napkin 1 below. Also visible is the releasing portion 12 on the lower side 3 of the uppermost napkin 1. It will be understood that the engagement between the adhering portion 10 and the releasing portion 12 allows a stable stack 30 of napkins 1 to be maintained and also ensures that suitable release of the uppermost napkin 1 is possible, without damaging the material of the napkin 1. In this sense, operation may be considered similar to the well-known sticky notes although with the particularity that in the case of the stack 30, the adhering portion 10 is provided on the upper side.

In use, a user may quickly and efficiently form cutlery wraps 20 directly from the stack 30, by placing the cutlery service 5 onto the stack 30 and wrapping or rolling the uppermost napkin 1 from the first corner 4A towards the second corner 4B to the point at which the engaging location 16 engages the adhering portion 10. At this point, continued rolling of the wrap 20, will release it from the stack 30, which is ready to receive the next cutlery service 5.

Figure 5:
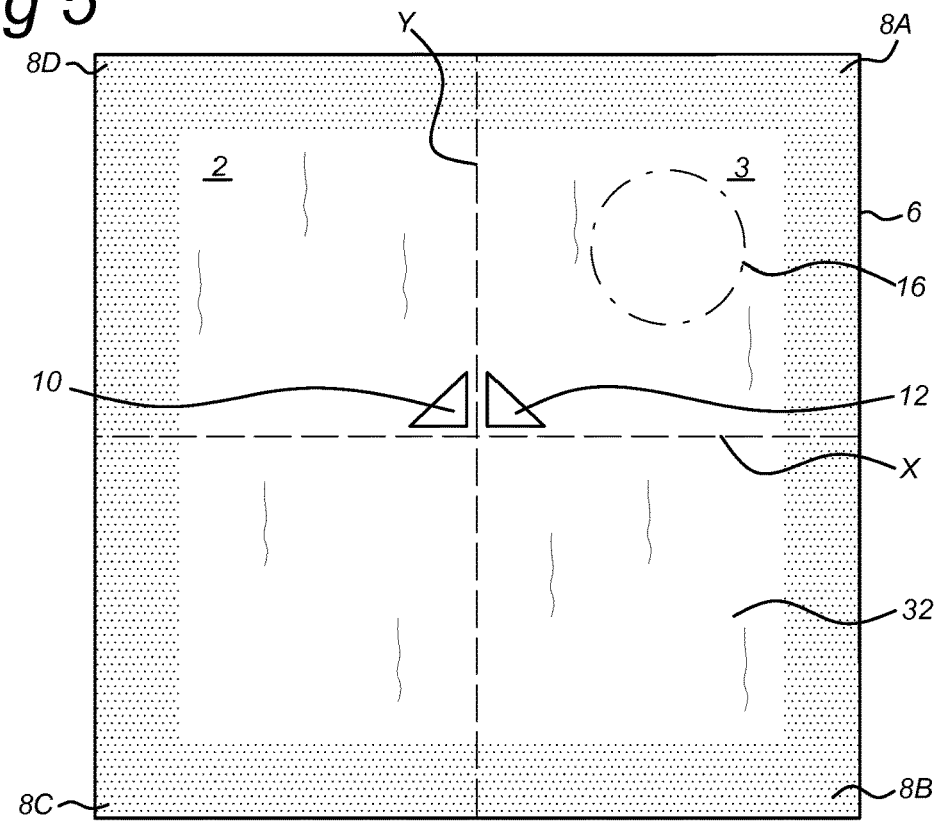
FIG. 5 is a top plan view of an unfolded napkin in accordance with one embodiment.

FIG. 5 is a plan view of the napkin 1 of FIG. 1 after unfolding the tissue sheet 6 to reveal its outer surface 32 and its four points 8A-D. The sheet 6 is twice-folded, across fold X and subsequently across fold Y to form the napkin 1. The upper side 2 of the napkin 1 is on the left side of the fold Y, while the lower side 3 of the napkin 1 is the portion on the right side of the fold Y. In this embodiment, the adhering portion 10 is located close to the center of the tissue sheet 6. The engaging location 16 is located centrally of the lower side 3 and as can be seen in this view, is considerably larger than either the adhering portion 10. The reason for this is that the wrap 20 may vary considerably in size, depending upon the cutlery service 5 and the position at which the adhering portion 10 engages with the lower side 3 of the napkin 1 may also be variable. If a releasing portion 12 is present, it is located adjacent to the adhering portion 10, with the adhering portion 10 and the releasing portion 12 on either side of the fold Y.

Figure 6:
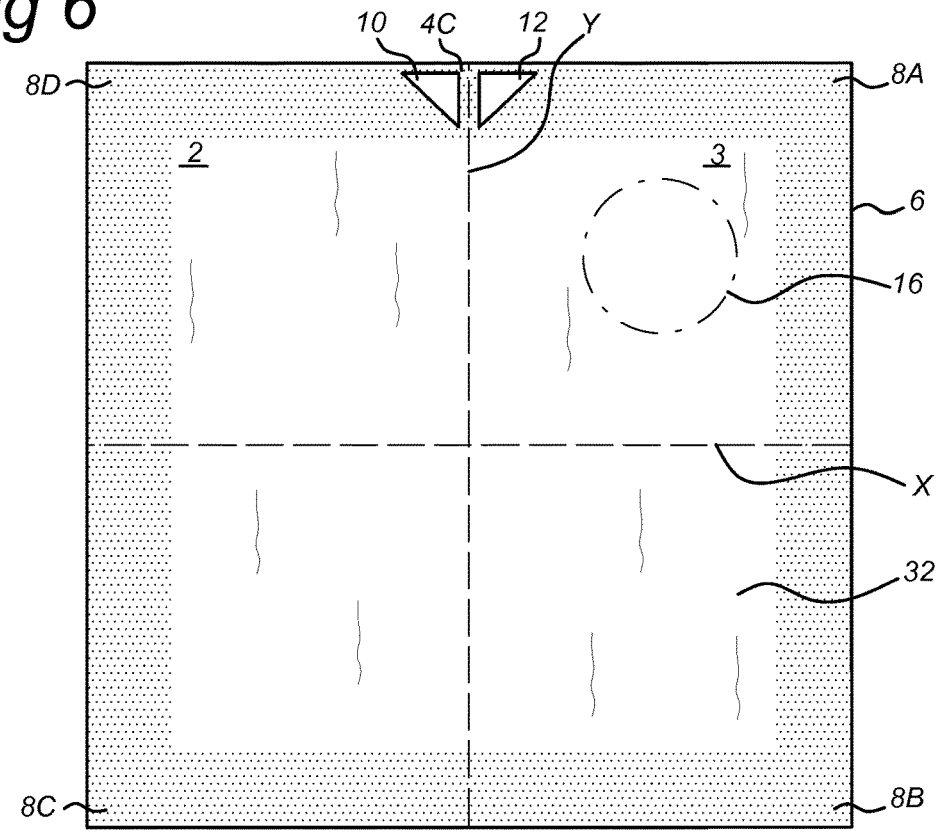
FIG. 6 is a top plan view of the unfolded napkin of FIG. 5, with the adhering portion positioned at a different location.

FIG. 6 is a plan view of a tissue sheet 6 that is otherwise identical to the tissue sheet of FIG. 5, with the exception of the location of the adhering portion 10 and the releasing portion 12, if present. In this case, the adhering portion 10 is located adjacent of the tissue sheet close to the third corner 4C. If a releasing portion 12 is present, it is located adjacent to the adhering portion 10, with the adhering portion 10 and the releasing portion 12 on either side of the fold Y. This has the advantage that the adhering portion 10 and, if a releasing portion 12 is present, the releasing portion 12 are kept away from the central region of the tissue sheet 6, where they might be more visible during use of the napkin.

Figure 7:
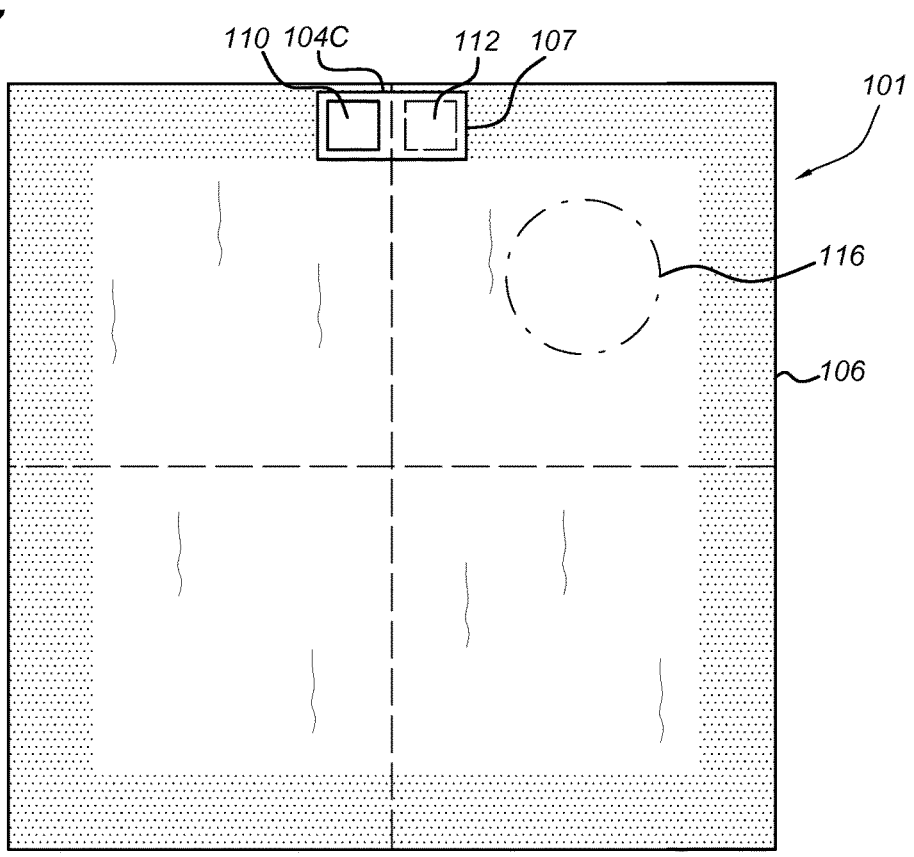
FIG. 7 is a top plan view of an alternative embodiment of an unfolded napkin.

FIG. 7 is a plan view of an unfolded napkin 101 according to an alternative embodiment. Like numerals preceded by 100 are used to designate similar elements. In this embodiment, the tissue sheet 106 is provided with a tape element 107, carrying the adhering portion 110 and the releasing portion 112. In this embodiment, both the adhering portion 110 and the releasing portion 112 are provided on the same tape element 107. It will however be understood that they could also be provided on separate tape elements and could also be spaced from each other. The tape element 107 is permanently adhered to the tissue sheet at the third corner 104C, corresponding to the alternative shown in FIG. 6, and is aligned such that the adhering portion 110 will attach to the engaging location 116. It will be understood that the tape element 107 could have been located at the second corner as in the embodiment of FIG. 5. In all other respects, this embodiment operates in a similar manner to the previous embodiment.

Figure 8:
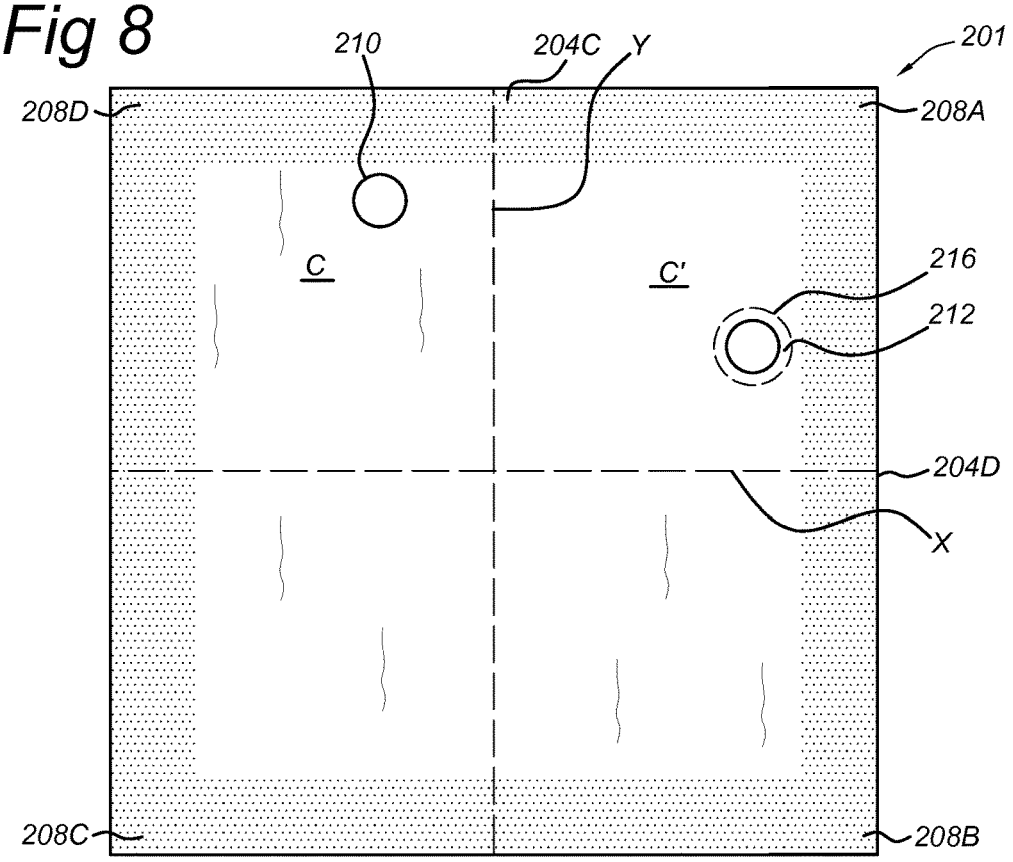
FIG. 8 is a top plan view of yet another embodiment of an unfolded napkin.

FIG. 8 is a plan view of an unfolded napkin 201 according to a still further embodiment. Like numerals preceded by 200 are used to designate similar elements to those of the first embodiment. In this embodiment, the adhering portion 210 is moved away from the third corner 204C in a diagonal direction towards the center C of the napkin 201. In this embodiment, the releasing portion 212 is located at a corresponding distance from what will become the fourth corner 204D, once the napkin 201 is folded, in the direction of the center C' of the lower side 203 of the napkin. This position of the releasing portion 212 ensures that it can also act as the engaging location if the distance between the adhering portion 210 and the releasing portion 212 corresponds to the wrapping circumference of the cutlery item. In the case of the embodiment of FIG. 8, napkins 201 will be stacked alternately with the third corner 204C overlying the fourth corner 204D of the napkin beneath and vice versa. In this way, the releasing portion 212 will overly the adhesive portion 210 of the napkin below.

Figure 9:
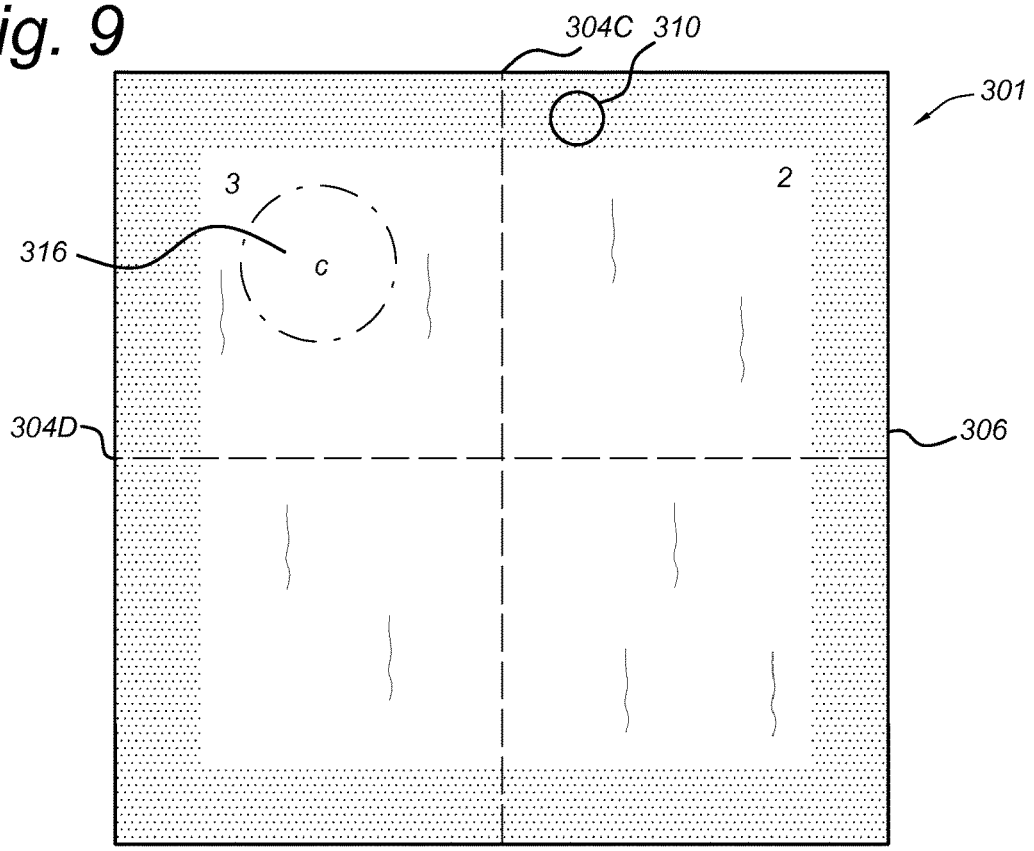
FIG. 9 is a top plan view of a further embodiment of an unfolded napkin.

FIG. 9 is a plan view of an unfolded napkin 301 according to a still further embodiment. Like numerals preceded by 300 are used to designate similar elements to those of the first embodiment and of the second embodiment. The upper side 2 is on the right side of the fold Y, while the lower side 3 is at the left side of the fold Y. In this embodiment, the adhering portion 310 is located on the upper side 2 adjacent the third corner 304C. The engaging location 316 is located on the lower side 3 on the diagonal from the third corner 304C to the fourth corner 304D close to the center C of the napkin 301. The engaging location 316 is considerably larger than the adhering portion 310. The adhering portion 310 comprises for example a circular portion with a diameter of 26 mm, the engaging location 316 comprises for example a circular portion with a diameter of 64 mm.

Figure 10:
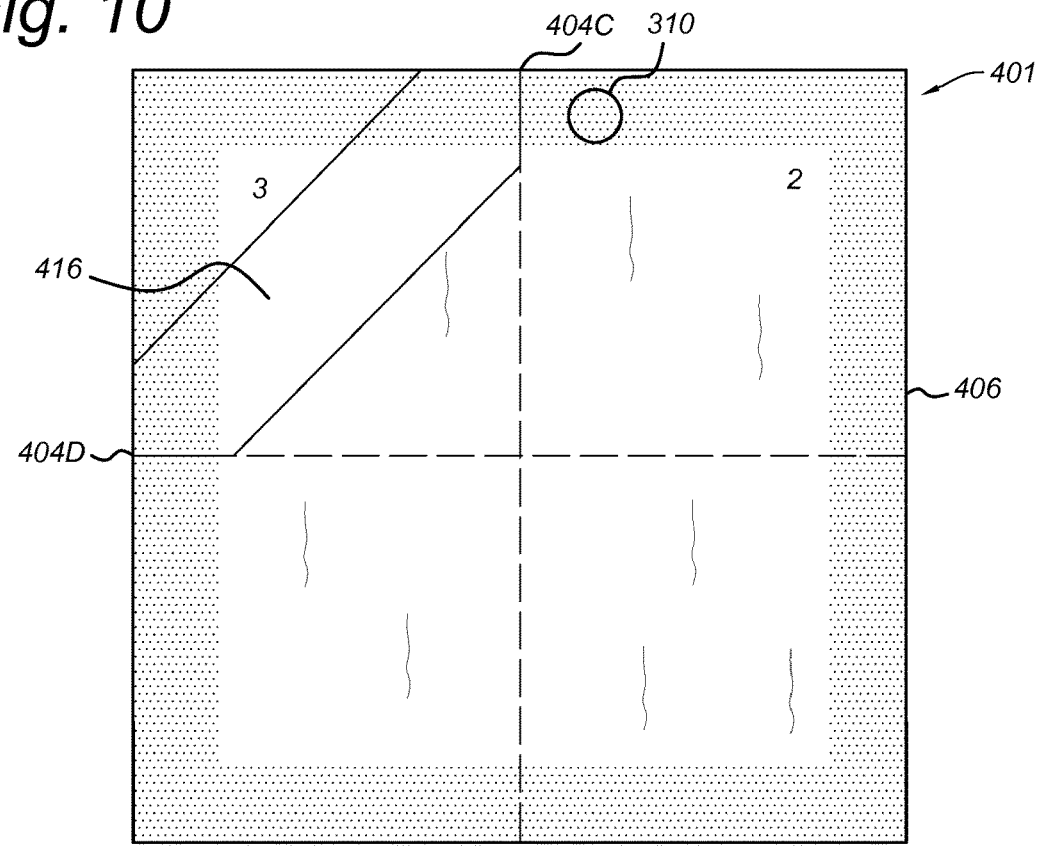
FIG. 10 is a top plan view of another embodiment of an unfolded napkin.

FIG. 10 is a plan view of an unfolded napkin 401 according to a still further embodiment. Like numerals preceded by 400 are used to designate similar elements to those of the previous embodiments. The embodiment of FIG. 10 is identical to the embodiment of FIG. 9, with the exception of the engaging location 416. The engaging location 416 is located on the lower side 3 of the napkin 401 and extends from the third corner 404C to the fourth corner 404D.

Thus, the invention has been described by reference to the embodiments discussed above. It will be recognized that these embodiments are susceptible to various modifications and alternative forms well known to those of skill in the art. In particular, the arrangement of adhering portions and engaging locations may be distinct from the schematically illustrated designs both in position and in shape.

Many modifications in addition to those described above may be made to the structures and techniques described herein without departing from the invention. Accordingly, although specific embodiments have been described, these are examples only and are not limiting upon the scope of the invention.

What is claimed is:

1. A folded napkin, wherein the napkin is formed from a sheet of napkin material, having an inner surface and an outer surface and being folded at least once with the inner surface inwards, the folded napkin having an upper side and a lower side and four corners and being provided with an adhering portion and an engaging location with both the adhering portion and the engaging location being located on the outer surface, the adhering portion being located on the upper side and the engaging location being located on the lower side at corresponding positions such that the napkin can be wrapped around an object and secured by engaging the adhering portion with the engaging location and can be subsequently unfolded for use, the adhering portion and the engaging location being provided with a mutually adhesive material to allow the adhering portion and the engaging location to releasably adhere to each other, wherein the mutually adhesive material does not adhere to the napkin material, and wherein the engaging location is located close to a center of the napkin and wherein corners on the lower side are devoid of the mutually adhesive material.

2. The napkin of claim 1, wherein the adhering portion is located at a first corner of the napkin.

3. The napkin of claim 2, wherein the engaging location comprises a zone extending substantially from the first corner to a diagonally opposite second corner, wherein the adhesive material of the adhering portion and the engaging location comprises a water based acrylic adhesive, a pressure sensitive hot melt, a cold seal adhesive, male-male connections or male-female connections, wherein the engaging location is provided only at positions such that the napkin can be stacked with similar napkins with the engaging location not aligned and not engaged with the adhering portion of an adjacent napkin, wherein the napkin is formed from a sheet having an inner surface and an outer surface and being folded at least once with the inner surface inwards, both the adhering portion and the engaging location being located on the outer surface, and wherein the sheet is at least twice-folded to form the napkin with the outer surface exposed.

4. The napkin of claim 1, wherein the adhesive material of the adhering portion and the engaging location comprises a water based acrylic adhesive, a pressure sensitive hot melt, a cold seal adhesive, male-male connections or male-female connections.

5. The napkin of claim 1, wherein the engaging location is provided only at positions such that the napkin can be stacked with similar napkins with the engaging location not aligned and not engaged with the adhering portion of an adjacent napkin.

6. The napkin of claim 1, wherein the sheet is at least twice-folded to form the napkin with the outer surface exposed.

7. The napkin of claim 1, wherein the sheet is a multi-ply tissue having a weight per ply of between 14 and 30 g/m$^2$.

8. The napkin of claim 1, wherein the sheet is a single-ply air-laid non-woven having a weight of between 25 and 80 g/m$^2$.

9. The napkin of claim 1, wherein the sheet is a single-ply tissue having a weight of between 14 and 40 g/m$^2$.

10. The napkin of claim 1, wherein the sheet has maximum dimensions of between 20 cm and 60 cm.

11. The napkin of claim 1, wherein the outer surface of the sheet is patterned or embossed.

12. A cutlery wrap, comprising:

the napkin of claim 1; and one or more items of cutlery, wrapped in the napkin, the wrap being secured by engagement of the adhering portion with the engaging location.

13. A method of wrapping cutlery to form a cutlery wrap, the method comprising:

providing a folded napkin, wherein the napkin is formed from a sheet of napkin material, having an inner surface and an outer surface and being folded at least once with the inner surface inwards, the folded napkin having an upper side, a lower side, four corners and being provided with, an adhering portion and an engaging location with both the adhering portion and the engaging potion being located on the outer surface, the adhering portion being located on the upper side, and the engaging location being located on the lower side at corresponding positions such that the napkin can be wrapped around an object and secured by engaging the adhering portion with the engaging location and can be subsequently unfolded for use, the adhering portion and the engaging location being provided with a mutually adhesive material to allow the adhering portion and the engaging location to releasably adhere to each other, wherein the mutually adhesive material does not adhere to the napkin material, and wherein the engaging location is located close to a center of the napkin and wherein corners on the lower side are devoid of the mutually adhesive material;

placing one or more items of cutlery onto the napkin;

wrapping the cutlery in the napkin; and engaging the adhering portion with the engaging location on the napkin to secure the wrap.

14. The method of claim 13, further comprising providing the napkin in a stack of napkins with the upper side of a top napkin exposed and the items of cutlery are placed onto the upper side of the top napkin.

* * * * *